US012416231B2

(12) United States Patent
Mohnke

(10) Patent No.: US 12,416,231 B2
(45) Date of Patent: Sep. 16, 2025

(54) SYSTEM AND METHOD FOR DATA HANDLING IN DOWNHOLE OPERATIONS

(71) Applicant: Baker Hughes Oilfield Operations LLC, Houston, TX (US)

(72) Inventor: Oliver Mohnke, Celle (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 181 days.

(21) Appl. No.: 18/371,192

(22) Filed: Sep. 21, 2023

(65) Prior Publication Data

US 2024/0093601 A1 Mar. 21, 2024

Related U.S. Application Data

(60) Provisional application No. 63/408,506, filed on Sep. 21, 2022.

(51) Int. Cl.

| | |
|---|---|
| ***E21B 47/11*** | (2012.01) |
| ***E21B 47/13*** | (2012.01) |
| ***G01V 5/10*** | (2006.01) |

(52) U.S. Cl.
CPC ..... *E21B 47/13* (2020.05)

(58) Field of Classification Search
CPC ..... E21B 47/111; G01V 3/32; G01V 5/10
See application file for complete search history.

(56) References Cited

U.S. PATENT DOCUMENTS 3,667,035 A * 5/1972 Slichter ..... G01V 3/32 324/303
4,055,763 A * 10/1977 Antkiw ..... G01V 5/102 250/252.1
4,529,877 A * 7/1985 Arnold ..... G01V 5/06 250/266

(Continued)

FOREIGN PATENT DOCUMENTS

CN 101078775 A * 11/2007
CN 101640802 2/2010

(Continued)

OTHER PUBLICATIONS

CN-101078775-A English Language Translation (Year: 2007).*

(Continued)

*Primary Examiner* — Curtis A Kuntz
*Assistant Examiner* — Jerold B Murphy
(74) *Attorney, Agent, or Firm* — Hogan Lovells US LLP

(57) ABSTRACT

A system and associated method for data handling in downhole operations uses a downhole tool to receive signals from a downhole environment and uses at least one processor that causes the system determine encoded data for the signals, where the encoded data is based in part on coefficients associated with at least one predetermined fitting curve that is applied to data from different areas of the signals, and where the coefficients include at least one difference between the data of the different areas of the signals and the at least one predetermined fitting curve. The system is further to transmit the encoded data from the downhole (Continued)

environment to a surface environment and also to determine at least one parameter or levels of an element in the downhole environment based in part on decoding the encoded data.

20 Claims, 8 Drawing Sheets

(56) References Cited

U.S. PATENT DOCUMENTS

| | | | | |
|---|---|---|---|---|
| 4,668,863 | A * | 5/1987 | Gray | G01V 5/101 250/262 |
| 4,730,263 | A * | 3/1988 | Mathis | G01V 5/06 378/70 |
| 5,374,823 | A * | 12/1994 | Odom | G01V 5/104 250/269.1 |
| 5,519,668 | A | 5/1996 | Montaron | |
| 5,608,214 | A | 3/1997 | Baron | |
| 6,405,136 | B1 | 6/2002 | Li | |
| 6,932,167 | B2 | 8/2005 | Proett | |
| 7,167,101 | B2 | 1/2007 | Golla | |
| 7,272,504 | B2 | 9/2007 | Akimov | |
| 8,274,399 | B2 | 9/2012 | Strachan | |
| 8,949,098 | B2 | 2/2015 | King | |
| 9,866,835 | B2 | 1/2018 | Gelman | |
| 9,932,824 | B2 | 4/2018 | Yu | |
| 10,310,134 | B2 | 6/2019 | Galford | |
| 10,473,802 | B2 | 11/2019 | McCleskey | |
| 10,591,630 | B2 | 3/2020 | Berheide | |
| 10,670,736 | B2 | 6/2020 | Morys | |
| 11,649,719 | B2 | 5/2023 | Mohnke | |
| 2007/0027629 | A1 | 2/2007 | Hassan | |
| 2007/0198192 | A1 | 8/2007 | Hsu | |
| 2007/0223822 | A1 * | 9/2007 | Haugland | G01V 11/002 382/232 |
| 2008/0116365 | A1 | 5/2008 | Flecker | |
| 2012/0001776 | A1 | 1/2012 | Yu | |
| 2012/0014452 | A1 | 1/2012 | Maani | |
| 2012/0169841 | A1 | 7/2012 | Chemali | |
| 2012/0197528 | A1 | 8/2012 | Le | |
| 2012/0321209 | A1 | 12/2012 | Le | |
| 2014/0161206 | A1 | 6/2014 | Kamra | |
| 2014/0286538 | A1 | 9/2014 | Yu | |
| 2015/0330168 | A1 | 11/2015 | Sun | |
| 2016/0290128 | A1 | 10/2016 | Dugas | |
| 2017/0089195 | A1 | 3/2017 | Yu | |
| 2017/0167247 | A1 | 6/2017 | Gao | |
| 2017/0170842 | A1 | 6/2017 | Sun | |
| 2020/0241166 | A1 | 7/2020 | Marsh | |
| 2020/0392836 | A1 | 12/2020 | Mohnke | |

FOREIGN PATENT DOCUMENTS

| | | | | |
|---|---|---|---|---|
| CN | 102946538 | | 2/2013 | |
| CN | 103002280 | | 3/2013 | |
| GB | 2346968 | A * | 8/2000 | G01V 5/101 |
| GB | 2437152 | | 10/2007 | |
| GB | 2437152 | A * | 10/2007 | A61M 1/0049 |

OTHER PUBLICATIONS

International Search Report and Written Opinion mailed Jan. 15, 2024 in corresponding PCT Application No. PCT/US2023/033389.

Ida Hooshyari Far, "Gamma Ray Spectroscopy for Logging While Drilling in Mineral Exploration," Western Australian School of Mines—Department of Exploration Geophysics, Mar. 19, 2018, retrieved from: https://espace.curtin.edu.au/handle/20.500.11937/69349, retrieved on: Oct. 21, 2021, 170 pages.

International Search Report and Written Opinion mailed Sep. 25, 2020 in corresponding PCT Application No. PCT/US2020/037218.

"Licenses for Standards and Other Technology Platforms; MPEGLA—The Standards for Standards;" Retrieved Online from https://www.mpegla.com; 2021; 1 page.

"Series H: Audiovisual and Multimedia Systems—Infrastructure of Audiovisual Services—Coding of Moving Video—Advanced Video Coding for Generic Audiovisual Services;" ITU-T; Telecommunication Standardization Sector of ITU; H. 264; May 2003; 282 Pages.

Uuurlink et al., "Scalable Parallel Programming Applied to H.264/AVC Decoding;" Springer Briefs in Computer Science; 2012; 12 Pages.

Akkurt et al.; "Collaborative Development of a Slim LWD NMR Tool: From Concept to Field Testing;" Saudi Aramco Journal of Technology; Fall 2009; 14 Pages.

Uthayakumar et al.; "A Survey on Data Compression Techniques: From the Persepctive of Data Quality, Coding Schemes, Data Type and Applications;" Journal of King Saud University—Computer and Information Sciences; 2018; 22 Pages.

* cited by examiner

SYSTEM AND METHOD FOR DATA HANDLING IN DOWNHOLE OPERATIONS

CROSS-REFERENCES TO RELATED APPLICATIONS

This application is related to and claims the benefit of priority from U.S. Provisional Application 63/408,506, titled SYSTEM AND METHOD FOR DATA HANDLING IN DOWNHOLE OPERATIONS, filed Sep. 21, 2022, the entire disclosure of which is incorporated by reference herein for all intents and purposes.

BACKGROUND

1. Field of Invention

The disclosure herein relates in general to equipment used in the natural gas industry, and in particular, to data handling in downhole operations such as logging-while-drilling operations.

2. Description of the Prior Art

A drilling well is a structure formed in subterranean or underwater geologic structures, or layers. Such subterranean or underwater geologic structures or layers incorporate pressure that may be further enhanced by supplementing formation fluids (such as liquids, gasses or a combination) into a drill site or a well site (such as a wellbore). Certain downhole operations including Logging-while-drilling (LWD) operations may use one or more downhole tools with capability to evaluate elemental compositions in a downhole environment. Such elemental composition or levels may include content of potassium (K), uranium (U), and thorium (Th) (referenced in combination as KUTh) in the downhole environment. However, such downhole tools may need to communicate with surface equipment at a limited bandwidth from the downhole environment.

SUMMARY

In at least one embodiment, a method for data handling in downhole operations is disclosed includes providing a downhole tool to receive signals from a downhole environment and includes determining encoded data for the signals. The encoded data is based at least in part on coefficients associated with at least one predetermined fitting curve applied to data from different areas of the signals. Further, the coefficients include at least one difference between the data of the different areas of the signals and the at least one predetermined fitting curve. The method also includes transmitting the encoded data from the downhole environment to a surface environment and determining at least one parameter or levels of different elements in the downhole environment, based in part on decoding the encoded data.

In at least one embodiment, a system for data handling in a downhole operation includes a downhole tool to receive signals from a downhole environment, memory storing instructions, and a processor to execute the instructions from the memory to cause the system to perform functions. The system is caused to determine encoded data for the signals. The encoded data is based at least in part on coefficients associated with at least one predetermined fitting curve applied to data from different areas of the signals. The coefficients include at least one difference between the data of the different areas of the signals and the at least one predetermined fitting curve. A further function is to transmit the encoded data from the downhole environment to a surface environment. The encoded data includes at least one parameter or levels of different elements in the downhole environment.

BRIEF DESCRIPTION OF THE DRAWINGS

Various embodiments in accordance with the present disclosure will be described with reference to the drawings, in which.

DETAILED DESCRIPTION

Figure 1:
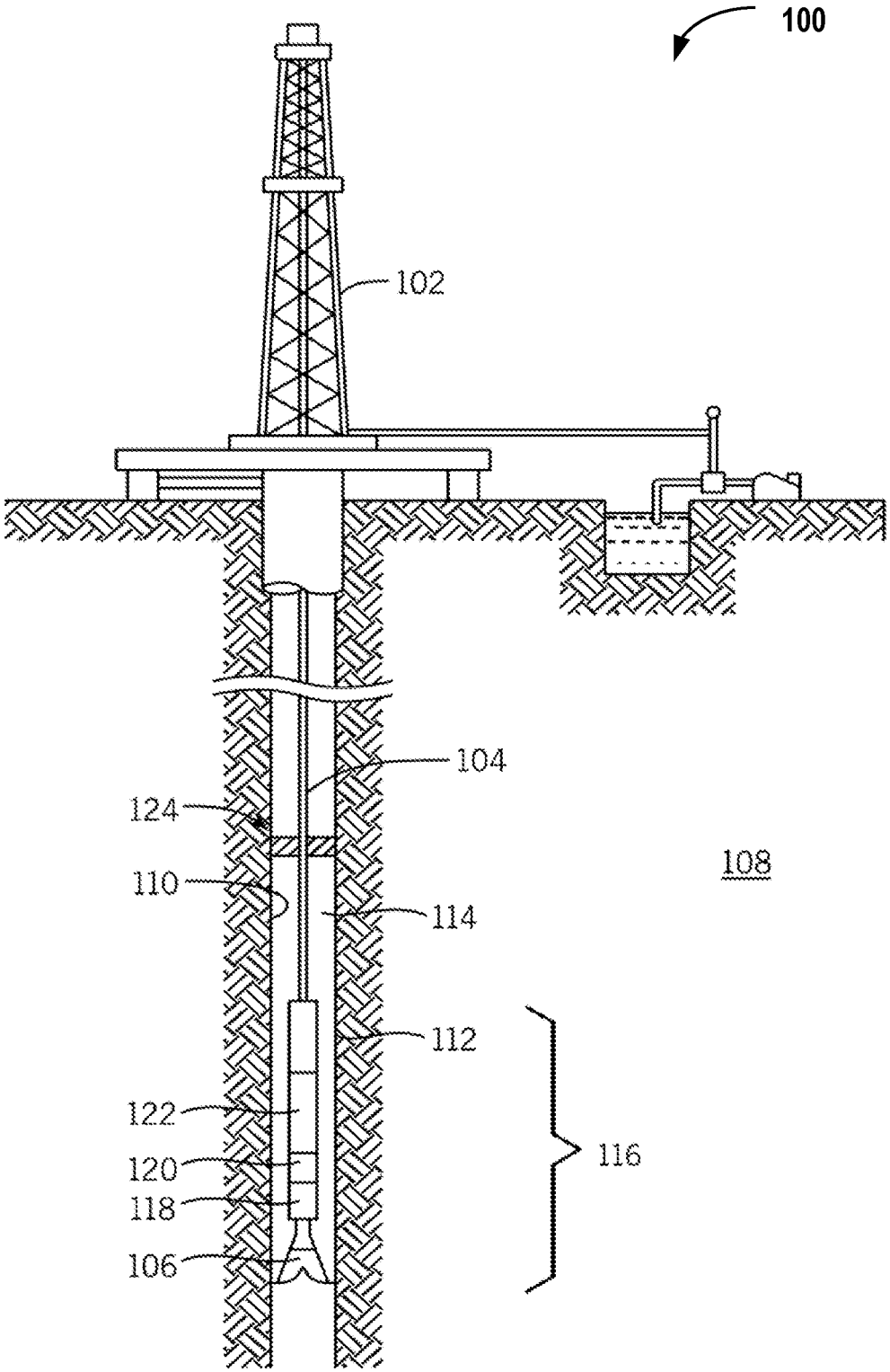
FIG. 1 illustrates an example environment subject to processes of at least one embodiment herein.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described. Various other functions can be implemented within the various embodiments as well as discussed and suggested elsewhere herein.

In at least one embodiment, a system and method herein can address such deficiencies raised and noted throughout herein by including a downhole tool having one or more subsystems for handling data communications. A Spectral Gamma Ray (SGR) data communication system includes a processor that can communicate using 512 or 256 channel data spectra. For example, such an SGR communication system may be semi-automatic and support complex data communication, but may not support current LWD aspects.

In at least one embodiment, an SGR communication system may not work with downhole tools because of at least the amount of data to be transmitted and because of environmental corrections required to energy channels or windows, representing areas of interest of the signals of the downhole environment to be transmitted to a surface. The areas of the signals may be required for determining levels (such as occurrences) of elemental content, such as for KUTh content in the downhole environment. Furthermore, there is limited bandwidth available for downhole tools to support roundtrip communication in LWD operations. In at least one embodiment, such limited bandwidth may be about 3 bits/second. In an alternative embodiment, such limited bandwidth may be about 10 bits/second.

In at least one embodiment, while windowed data sets of a few summed energy windows (such as, 3, 9 or 16 energy windows) may be compiled to be transmitted as windowed data, such a process still generates higher data points requiring about 32 bits per datapoint to be transmitted from a downhole environment. This approach at least consumes or occupies available bandwidth for an extended period and may require keeping a downhole tool at each depth location for extended periods than intended. In at least one embodiment, such communication is provided via mud-pulse telemetry (MPT), acoustic telemetry, or electromagnetic telemetry from a downhole environment, to a process at a surface environment.

In at least one embodiment, data communications herein may need to communicate a collection of natural gamma ray signals having a spectrum over an energy range, such as from 60 kilo electron volt (keV) to 2400 keV in 512 energy channels. Such gamma ray signals can be used to identify contributions to energy windows from different elements, such as Potassium (K), Thorium (Th), and Uranium (U). For example, a 3 component inversion (for KUTh elements) may be used with environmental corrections (to address applied error from applied fluid that is not part of a downhole environment but that may be used in drilling operations or from natural error caused by a borehole size). In at least one embodiment, such applied fluid may be applied mud.

In at least one embodiment, to address such shortcomings, a system and method herein handles data by compressing energy window data using an encoding process that combines a functional transformation pre-fitting and differential coding. Further, for signals that are spectral gamma ray signals, logarithmic data may be used, such as counts or count rates of gamma radiation. In at least one embodiment, a system and method herein enables compression to transmit collected data from a downhole environment in near real time as part of the data handling operations discussed herein, which allows for the data to be realized as to elemental compositions in near real time.

In at least one embodiment, a system and method herein downscales the data of the 512 channels to N number of energy windows. The channels contributing to an energy window define a breadth (or width) of an energy window associated with known energy ranges of elements, such as KUTh elements. In at least one embodiment, the N number of channels may be nine channels. In at least one embodiment, the breadth may be defined by three to twenty datapoints that contribute data, at least from a transformation function, such as a logarithmic transformation applied to collected energy values within the collected energy windows. In at least one embodiment, the three to twenty data points may be a number of energy windows contributing data to be compressed. Further, an energy window may be the sum of any subset of channels. In at least one embodiment, a sum of channels 1-100 may be a first energy window, a sum of channels 101-150 may be a second energy window, and so on.

In at least one embodiment, the logarithmic transformation is part of an encoding applied to the collected data. Such encoding is performed in the downhole environment using at least one processor or an encoder that is part of a downhole tool and that is associated with memory having instructions to allow such at least one processor or an encoder to perform functions described throughout herein. In at least one embodiment, at least one processor or a decoder in a surface environment can be used to decode the encoded data from the downhole tool.

In at least one embodiment, an inverse transformation function, such as an inverse logarithmic transformation, may be applied as part of the decoding of the encoded data. In at least one embodiment, further, relative error levels (such as 10%) may be used in a decoding step of a surface environment to address the applied error described herein. Such a 10% error may be a result from lossy encoding between input data and decoded data. For example, such a percentage error information may be a prerequisite to allowing sufficient accuracy in determined element content or composition, such as from KUTh elements, of the decoded data.

In at least one embodiment, FIG. 1 illustrates an example environment subject to processes described herein. FIG. 1 may be a schematic view of an embodiment of a logging while drilling (LWD) system 100, in accordance with at least one embodiment herein. The LWD system 100 may include a rig 102 and a drill string 104 coupled to the rig 102. However, other implementations of a LWD system may incorporate features of a method and system disclosed herein. The drill string 104 includes a drill bit 106 at a distal end that may be rotated to engage an underground or earth formation 108 and form a wellbore 110.

The drill string 104 can be formed from one or more tubulars that are mechanically coupled together (such as via threads, specialty couplings, or the like). As illustrated, the wellbore 110 includes a borehole sidewall 112 and an annulus 114 between the wellbore 110 and the drill string 104. Moreover, a bottom-hole assembly (BHA) 116 can be positioned at the end of the drill string 104. In the example shown, the BHA 116 can be positioned at a bottom of the wellbore 110. The BHA 116 may include a drill collar 118, stabilizers 120, or the like.

In at least one embodiment, the LWD system 100 includes various tools 122, such as logging tools and surface logging tools, which may be utilized to obtain measurements from the formation 108. The logging tools, which are part of the BHA, include, for example, logging while drilling tools and a downhole tool as described herein, which may include nuclear tools, acoustic tools, seismic tools, magnetic resonance tools, resistivity tools, sampling tools, and the like.

Figure 6:
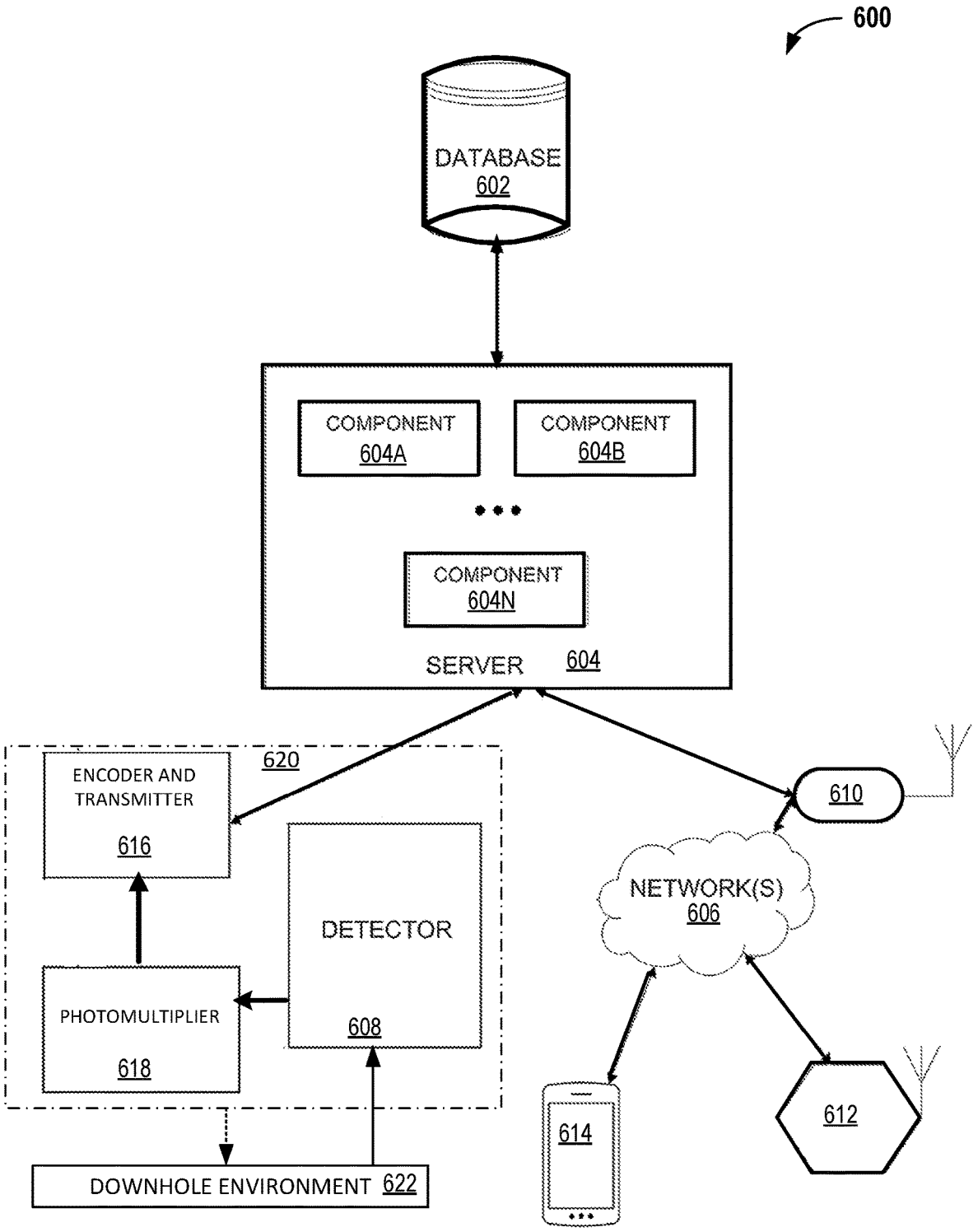
FIG. 6 illustrates a system for data handling in downhole operations, according to at least one embodiment.

Further, computing aspects may be provided at least as discussed with respect to FIG. 6 to enable data handling in downhole operations. The aspects in FIG. 6 may be located above ground in a surface environment and partly in a downhole tool of the LWD system 100 that is in an downhole environment but can communicate to the surface environment outside the borehole. When located above ground, such aspects in FIG. 6 may be within the drill or well site, or may be at a remote facility that is other than the drill or well site.

While an LWD system 100 is described, in part, at least one embodiment herein may be used in a measurement-while-drilling (MWD) or a logging-while-tripping (LWD) operation. Further, at least one embodiment herein may be used in a slickline implementation, in a coiled-tubing implementation, or in borehole operations that may incorporate resistivity logging techniques, all of which can benefit from the present data handling features.

In at least one embodiment, a sensor assembly (such as, a detector/receiver) may be provided to be conveyed downhole on a slickline. This is so that data from the downhole environment may be recorded on a suitable memory device, processed (such as encoded), and communicated or retrieved for subsequent processing in real time or near real time. A downhole tool, as described herein and having such a sensor assembly, can include a crystal scintillator and a photomultiplier as part of the sensor assembly and can include an encoder (or a processor having an encoder). Further, a transmitter is provided for communicating data handled by the downhole tool to the surface environment outside the borehole.

Figure 2:
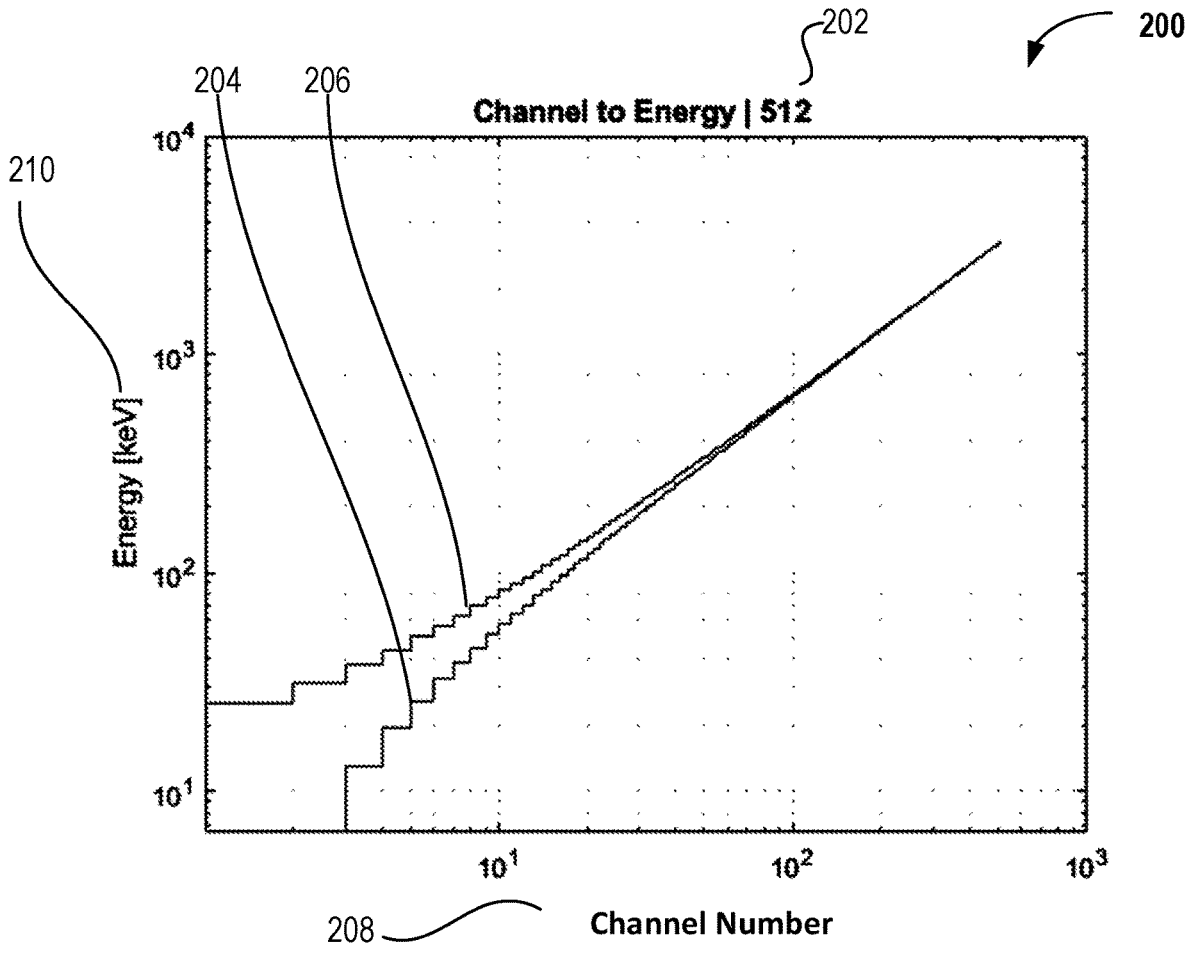
FIG. 2 illustrates a plot of a translation of channel number to energy levels for communications from a downhole environment and which subject to processes of at least one embodiment herein.

FIG. 2 illustrates a plot 200 of a translation of channel numbers to energy levels. For example, the channels as displayed in plot 200 are configured to gather count data from natural gamma ray (GR) signals in a downhole environment. In at least one embodiment, the energy levels include an energy range, such as from 60 keV to 2800 keV in 512 energy channels 202. In at least one embodiment, the translation of energy levels to channel numbers is required as the detector may be an interacting crystal and photomultiplier to measure count rates (within an energy window) of impinging radiation energies. The translation of energy levels to channel numbers may also be referred to as a calibration of the detector.

In at least one embodiment, the plot 200 illustrates two translations of energy levels to channels 204, 206. The two translations may coincide at higher energy channels 208. To address bandwidth restrictions, only channel number ranges that are of relevance to gamma radiation from elements at issue may be selected. However, more channels used in identifying the occurrence of radioactive elements in a downhole environment can contribute to a better resolution (such as a higher resolution) of the binned signals or data corresponding to the elements.

In the example of FIG. 2, the channel numbers 208 that provide energy ranges corresponding to the KUTh elements are known on a receiving side, such as at a surface environment. In at least one embodiment, as such, only datapoints (associated with certain channels) or energy windows for those ranges need be provided and a system in the surface environment receives such datapoints for sequential channel numbers. So, it may not be important to identify more than the datapoints in such a process. However, each datapoint is represented in 32 bits, which is time-consuming for a 3 bits/second bandwidth, in at least one example. Moreover, such elemental detection may be needed at multiple depth locations and so, a downhole tool is required to be moved within a predetermined time or at a predetermined rate of penetration (passed depth interval per time) and data communication may not be in real time or may cause delay to such detection requirements.

Figure 3:
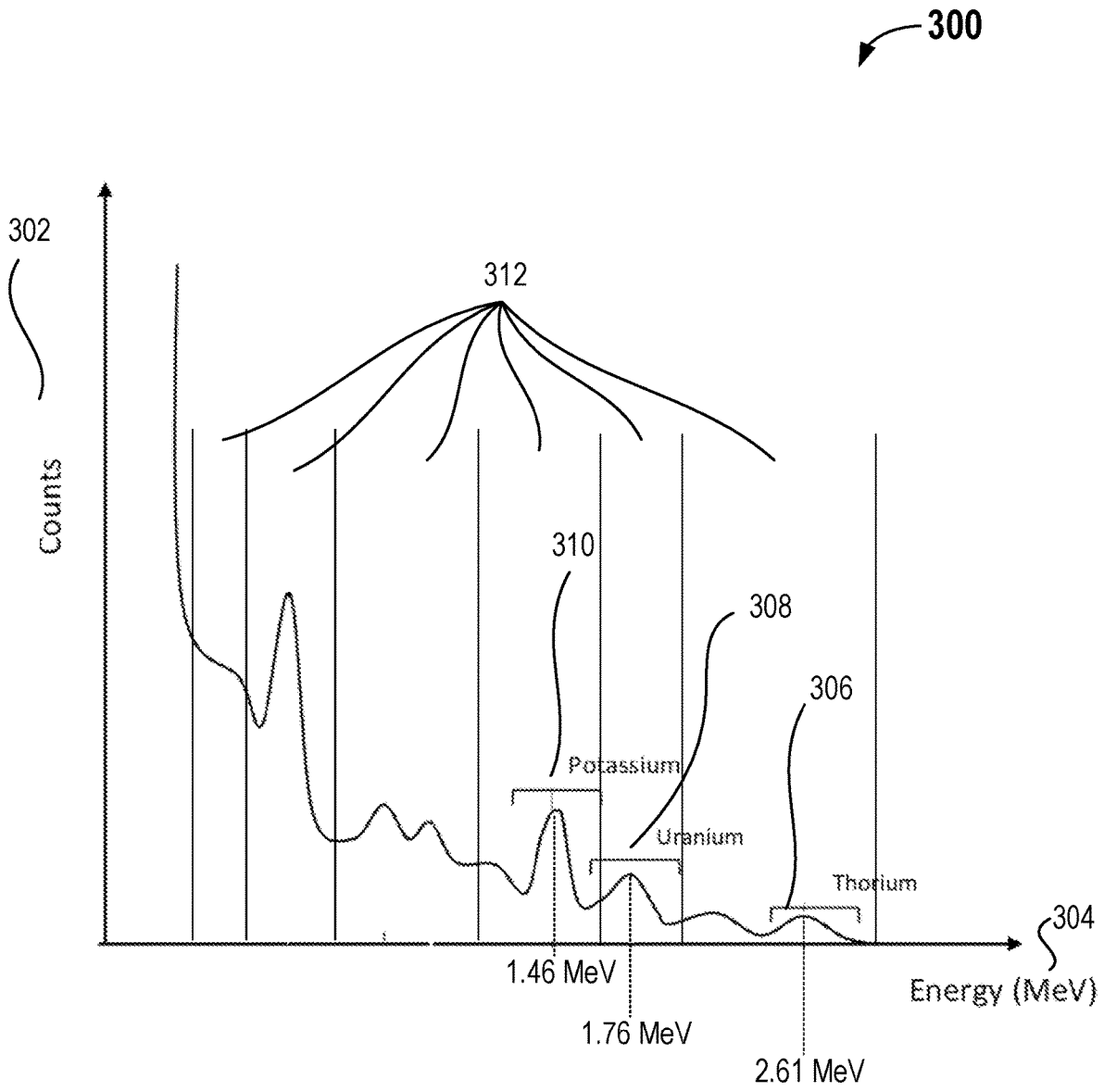
FIG. 3 illustrates a plot of the data that is associated with signals and that is subject to encoding in at least one downhole tool of at least one embodiment herein.

FIG. 3 illustrates a plot 300 of data that is associated with signals and that is subject to encoding in at least one downhole tool of at least one embodiment herein. Such signals may be interchangeably used with GR signals herein. The signals may originate from gamma emitting elements in the downhole environment. The gamma emitting elements may be located in the downhole formation 108 (FIG. 1), in the borehole fluid, or in radioactive tracers placed in the formation or the borehole wall. The signals may form or define a signal curve. In FIG. 3 the signal curve represents Gamma count rate over energy. Further, FIG. 3 provides measurements (such as counts 302) that may be relied on for data encoding herein as Gamma counts over Energy (MeV) 304. Further, for each channel, an individual count rate may be determined. The count rates are associated with the channels and are within an energy window 312. The vertical lines indicate limits of energy windows. The energy windows are built based on energy channels as illustrated in FIG. 2. Each energy window combines a certain number of energy channels 208. The count rates in the energy channels (FIG. 2) that are combined to form on energy window may be summed to provide the total count rates of the energy window.

In at least one embodiment, for KUTh elemental detection and measurements, specific isotopes of radioactive elements $^{40}K$, $^{238}U$, and $^{232}Th$ decay chains that may be of relevance and may be therefore extracted from a GR energy spectrum of the GR signals (radiation). In at least one embodiment, a ratio of gamma counts of a GR signal may be measured. These counts pertain to a section of a Compton region (or Compton window) and a section from a photoelectric region (or photoelectric window or photopeak region) of a gamma-ray spectrum.

In at least one embodiment, a selection of an energy window 312 that pertains to an entire range (that is, faint detection to a strong detection and back to faint detection of each element) is required. In at least one embodiment, GR signals for the three example elements (K, U, Th), as measured from actual rock samples, and may be between 1.15 and 2.8 MeV 304 of a GR signal spectrum, which corresponds to a section of a Compton window.

In at least one embodiment, FIG. 3 illustrates the plot 300 of data that is specifically in three sections 306, 308, 310. The sections are associated with the KUTh elements or at least one parameter associated with an element of the downhole environment. In at least one embodiment, a second energy window that is a photoelectric window may be used to provide further information pertaining to different isotopes of the KUTh elements. In all such windows 312, it is possible to perform the compression for data handling discussed at least with reference to the Compton window, for example.

In at least one embodiment, instead of natural GR signals, the at least one parameter that is associated with an element of the downhole environment pertains to information from a pulsed neutron source in a downhole tool that is used with neutron-induced gamma radiation or spectroscopy in the downhole environment. The neutron-induced gamma spectroscopy includes neutron generation and gamma spectroscopy. In pulsed mode, separate gamma spectra can be acquired from neutron pulses. In at least one embodiment, neutron irradiation intensity can be associated with a duty cycle and frequency of a neutron generator. These aspects may be different between the pulse mode and a continuous mode available in neutron-induced gamma spectroscopy. In at least one embodiment, the use of neutron-induced gamma spectroscopy implies that the signals from the downhole environment are return signals (induced or scattered radiation) that are acquired and encoded in the compression approaches described throughout herein.

A background or portion of a gamma spectra radiated from a downhole environment may be acquired. In at least one embodiment, a gamma-detector may be used for such acquisition. Then, results of measurements of a neutron-induced gamma spectroscopy taken in a continuous mode (DC) or a pulse mode (INS) may be determined. Certain peak areas and standard deviations may be determined to provide information from the return signals. The areas of interest, for data of the neutron-induced gamma spectroscopy, may be the number of counts from the neutron-induced gamma spectroscopy of certain energy that is attributed to certain elements contribute to certain peak areas. Then, normalized peaks or areas in the neutron-induced gamma spectroscopy, as referenced with at least one predetermined fitting curve, may be used along with errors therein, to provide compressed or encoded data back to a surface equipment.

In at least one embodiment, therefore, a method for data handling in downhole operations includes data handling of return signals from neutron-induced gamma spectroscopy in the downhole environment. In at least one embodiment, such a method includes providing a downhole tool to receive return signals from neutron-induced gamma spectroscopy in the downhole environment. A further step in such a method includes determining encoded data for normalized peaks or areas in the return signals. The encoded data is based in part on coefficients associated with a transformation function applied to data of different peaks of the return signals.

In at least one embodiment, the coefficients of a fitting curve may include at least one error between data of different peaks of the return signals and at least one predetermined fitting curve. In at least one embodiment, the method includes transmitting the encoded data from the downhole environment to a surface environment. Furthermore, the method includes determining at least one parameter or levels (occurrences) of different elements in the downhole environment, based in part on decoding the encoded data.

In at least one embodiment, a method for data handling in downhole operations includes providing a downhole tool, such as described in FIGS. 1 and 6, to receive signals (such as GR signals or return signals neutron-induced gamma spectroscopy) from a downhole environment. The signals may be return signals, in one example, that are related to applied signals from a downhole tool that are applied to the downhole environment. Data underlying the plot 300 may be retrieved in a downhole tool from such signals. In at least one embodiment, even though illustrated in a plot 300 in FIG. 3, the underlying data from the signals alone may be used by the system and method described herein. In at least one embodiment, for example, a crystal scintillator and a photomultiplier may be coupled to a processor and can execute instructions from a memory to determine count information at select Compton windows of the data.

In at least one embodiment, a Compton window may be further divided into assigned energy windows 312. Such assigned energy windows may be a division of the energy scale 304 into three to twenty datapoints. In at least one embodiment, the number of energy windows may be predetermined using at least one rock sample tested for gamma-ray signals. In at least one embodiment, such predetermined number of energy windows may be between three to twenty energy windows.

In at least one embodiment, some of these energy windows 312 may encompass the sections of the Compton window having an entire energy range of radiation of KUTh elements, as illustrated. Such energy windows 312 may be predetermined and associated with energy levels 304 for received counts 302. Further, the number of points for the individual ones of the different energy windows may be based at least in part on a width of the individual ones of the different energy windows. Still further, for a wider width of an energy window, there may be a higher number of points or datapoints (counts in associated channels) that may be assigned to the energy window.

In at least one embodiment, a processor can determine encoded data for the signals using in part such energy windows 312. In a first step, the counts or count rate 302 values of the datapoints in each energy window 312 is summed or averaged for the respective energy window 312 to provide a respective energy window average counts or count rates (EWavg). That is, counts related in energy channels that are combined to an energy window are summed to provide counts or count rates of the respective energy window. In at least one embodiment, the EWavg is normalized and is then subject to a logarithmic (log) transform.

In at least one embodiment, the log transform is a base 2 log transform. Log transform (EWavg) is a transformation function that represents this step. Further, values from the log transform (EWavg) function can be then related to a number of the energy window 312 from where it was summed or averaged, as part of the encoding process. In at least one embodiment, while a logarithmic approach herein is one approach to a transformation function, but other suitable transformation functions that may be applied to generate coefficients herein, including an inverse tangent, a square root, an arccosine, an exponent power, and other readily apparent functions based in part on the descriptions herein.

Figure 4A:
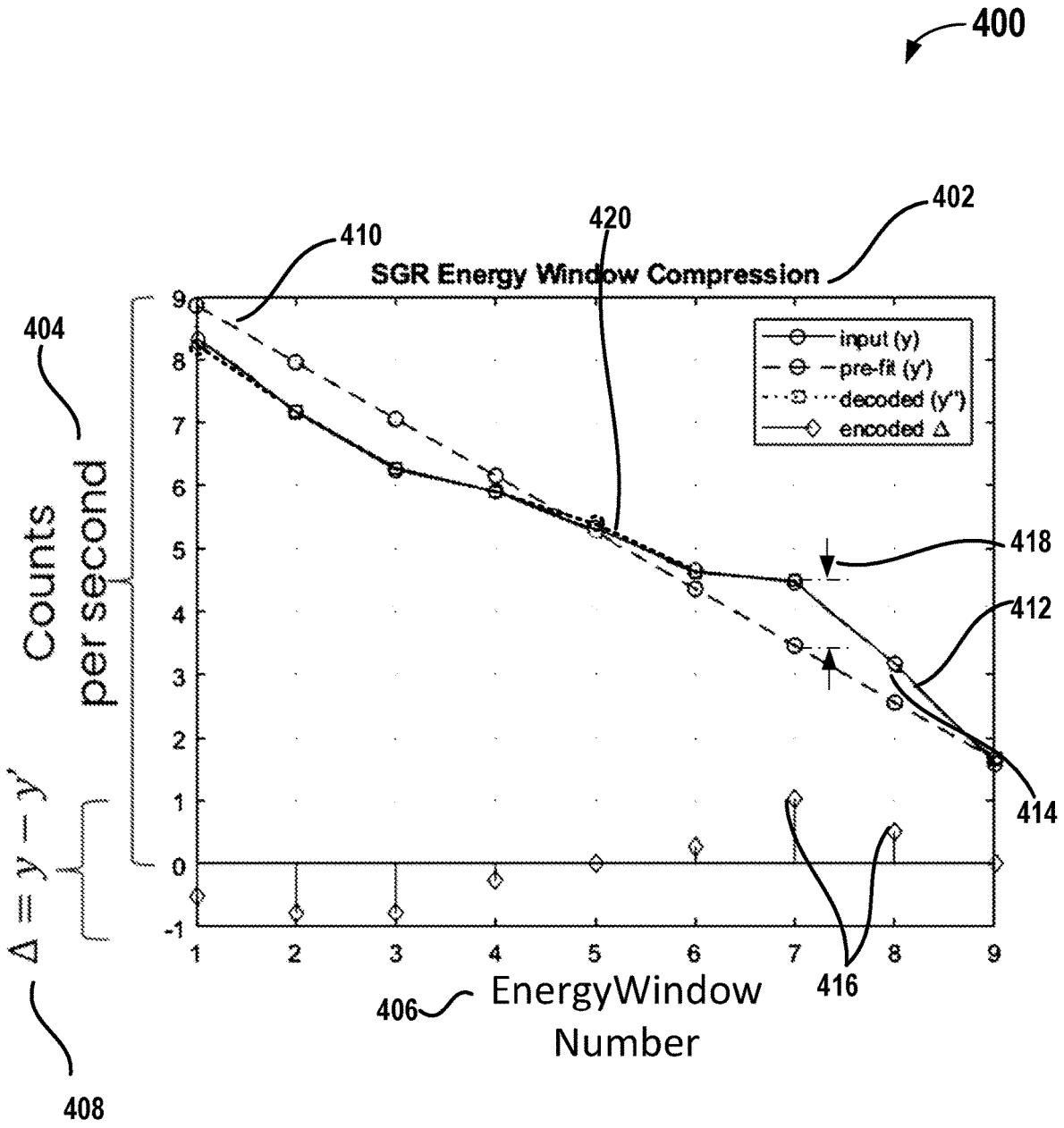
FIG. 4A illustrates features of the data associated with signals of at least one embodiment herein.

FIG. 4A illustrates features 400 of encoding data associated with signals of at least one embodiment herein. The features 400 pertain to an SGR energy window compression 402 using energy windows 406 and counts or counts per second 404 (count rate) associated with a transformation function, as a logarithmic transformation function. For example, the log transform (EWavg) (referenced as the normalized counts per second 404) on the y-axis includes datapoints 414 that is plotted to the number of the energy window 406 on the x-axis to form a transformed input curve (transformed signal curve). The signal curve includes multiple count rates in multiple energy windows.

In at least one embodiment, the features 400 include an input curve 412 which is an input that is subject to data handling, such as for compression described throughout herein. The input curve may be a signal curve formed from received signals (count or count rates) in the energy windows 406. In at least one embodiment, instructions in a memory associated with a processor may include one or more predetermined fitting curves 410 that are regression curves. For example, a logarithmic regression curve may be used, as one predetermined fitting curve 410, to fit the input curve 412 between the log transform (EWavg) and the energy window 406. In at least one embodiment, such predetermined fitting curves 410 may be a straight line and have different slopes and intercepts to attempt to find a best fit.

In at least one embodiment, the processor is able to determine errors 416 (or log difference 418) between the log transform (EWavg) value and a corresponding y-axis value of one or more predetermined fitting curves 410, at each number 406 of the energy window. The errors 416 may be actual differences 418 between each log transform (EWavg) value (transformed input curve) and each corresponding y-axis value of a predetermined fitting curve or may be normalized or scaled versions of the log differences to fit between a predetermined threshold, such as −1 to 1 (marked as log errors or differences 408 for illustrative purposes). Further, the errors may be differences that are scaled values (such as a 3 bit value in the range of +/−[0, 0.8]); but larger differences (such as 1.2) can be scaled to these values (such as to 0.8). In one embodiment the scaled values (variable number of bits) may be selected to represent the whole range of log differences, or the fitting curve may be selected to result in differences that can be represented by the scaled values (fixed number of bits). Therefore, the variable number of bits depends on a predetermined error and the predetermined error may be related to a difference between the signal curve and a decoded signal curve generated from the decoded data.

In at least one embodiment, therefore, at least one predetermined fitting curve may be selected from a number of predetermined fitting curves based at least in part on ensuring that the at least one error is within a predetermined threshold. Approaches herein attempt to secure a best fit using available scaled sets of coefficients (such as a slope and an intercept). However, for exemplary reasons, when a best fit would be achieved for a value of 6.6567, but where available points are part of the scaled 3 bit coefficient, then such transmission can only include one decimal point, such as [ . . . , 6.3, 6.5, 6.7 . . . ]. As such, for this example, 6.7 may be selected for the fitting curve. Further, the predetermined threshold may therefore pertain to limitations of the transmission.

In at least one embodiment, at least one predetermined fitting curve may be selected from a number of predetermined fitting curves based at least in part a statistical significance of errors being within a predetermined threshold. In at least one embodiment, this approach allows for scaled values for coefficients associated with a transformation function. Scaled values of an intercept and a slope with predetermined ranges may be obtained. For example, an intercept range, such as [5, 9] at 3 bits and a slope range as [0, 0.8] at 3 bits may be used as part of the scaled values.

In at least one embodiment, all or at least 90% of the errors between the log transform (EWavg) value and a corresponding y-axis value of predetermined fitting curve, for each number 406 of the energy window, may be within −1 to 1. In at least one embodiment, however, a percentage of errors may be a predetermined threshold and may be based in part on predetermined ranges and scaling parameters that are programmed into downhole tool prior to deployment to perform the data handling in downhole operations. These parameters may be changed during a run. For example, tool and telemetry rates may be programmed and reprogrammed by downlinks; the transformation function may be changed; and the fitting curve may be changed and, with it, the coefficients, or a predetermined error threshold may be changed.

In at least one embodiment, such selection of a predetermined fitting curve represents performing curve fitting between the logarithmic data of the different energy windows of the signals (such as counts or count rates) and the number of predetermined fitting curves having different slopes, different intercepts, stored within memory of the downhole tool (such as a look up table). In at least one embodiment, the selection of the at least one predetermined fitting curve from a number of predetermined fitting curves may be, therefore, based at least in part on a statistical significance for the at least one error being within a predetermined threshold. This allows incorporation of a best approximation to enable recreating the data from decoding the encoded data.

For example, a requirement may be to determine at least one of a number of predetermined fitting curves that has associated errors, with respect to the input data of different energy windows, that is a least number among number of errors for multiple predetermined fitting curves. When such a determination is made, where at least one of the predetermined fitting curves has all associated errors (differences) representing a least number of a percentage of error (such as 5% of the input data 412 and the predetermined fitting curve 410 demonstrate an error 418), then downhole tool herein, through its processor, is able to select this predetermined fitting curve to be used for encoding the data of the different energy windows.

In at least one embodiment, such a fitting process allows the encoded data to be based in part on coefficients of the transformation function. The coefficients can include a slope and an intercept of the predetermined fitting curve. The encoded data include the coefficients and at least one difference indicator indicating the value of the error, or difference, between the data (such as logarithmic data) of different energy windows of the signals in the input data (signal curve) and points on at least one predetermined fitting curve. The fitting may be represented by Equation (1) below.

$$\text{log 2-regression } y'=a*(\text{EnergyWindow Number}-1)+b \qquad \text{Equation (1)}$$

Equation (1) may be generalized as per Equation (2):

$$\text{log 2Regression } y'=w_0+\Sigma_{i=1}^{N} w_i\cdot(\text{EnergyWindowNumber}^i-1) \qquad \text{Equation (2)}$$

In Equation (2), relative to Equation (1), $a=w_1$ and $b=w_0$ and N=1. In at least one embodiment, the slope a and the intercept b represent stored coefficients (slope and intercept) of predetermined fitting curves that may be selected so that every point on a predetermined fitting curve is within a predetermined threshold or difference (representing the error) to the input data represented by a log transform (EWavg) value from the gamma-ray signals.

In at least one embodiment, encoding includes scaled log errors or differences 408 given by Equation (3)

$$\Delta=y-y' \qquad \text{Equation (3)}$$

As described elsewhere herein, y represents at least the y-axis log transform (EWavg) values from the gamma-ray signals, and therefore, the error or log difference is between y and y' where y' is from Equation (1) or (2).

In at least one embodiment, the encoded data is a compilation of the slope that contributes a 3-bits value to the encoded data, the intercept that contributes a 3-bits value to the encoded data, and the at least one difference indicator that contributes a 4-bits value to the encoded data. In at least one embodiment, each of such bit sizes are only exemplary and more or lesser bits may be used to represent such encoded data. The 4 bits may include a 3 bit numerical value and a 1 bit sign value (indicating positive or negative error). The encoded data is a digital representation of the input data (signal curve) 412.

Therefore, a total of 10 bits can be sufficient, in at least one embodiment, for communicating occurrences of elements of a downhole environment, such as KUTh elements, of one number 406 of the energy window to the surface environment. Further, the encoded data includes transmitting less than 10 bits per second to the surface environment. In at least one embodiment, therefore, the encoded data to be transmitted for all such energy windows is a[3 bits], b[3 bits], $\Delta_{1-X}$[9×4=36 bits], which represents 42 total bits for all datapoints for KUTh elements across all energy windows versus 32 bits required for each datapoints (not encoded) with reference to the features in FIG. 3.

FIG. 4A also illustrates that decoded data, such as a decoded input curve (decoded signal curve), (finer dashed line 420) almost coincides with the input curve 412. In at least one embodiment, once the encoded data is transmitted from the downhole environment and received at a surface environment outside the borehole, the levels (occurrences) of elements, such as Potassium, Uranium, and Thorium, in the downhole environment can be determined based in part on decoding the encoded data. In at least one embodiment, such decoding can include generating, as part of the decoding at the surface environment, representative data using the slope, the intercept, and the at least one error (differences) from the encoded data. In at least one embodiment, a part of such decoded data using the slope, the intercept, and the at least one error is illustrated as the finer dashed line 420. The decoded data is therefore faithful with the log transform (EWavg) values prior to encoding (input data or signal curve). In at least one embodiment, an aspect of decoding can be represented by Equation (4) as below.

$$y''=y'+\Delta \quad \text{Equation (4)}$$

In one embodiment, encoding may be performed with a predetermined number of bits, such as 3 bits for each coefficient (slope, intercept) of the fitting curve and 4 bits for each difference indicator resulting in 42 bits for a signal curve including nine difference indicators in nine energy windows. In one embodiment the number of bits to encode the signal curve may be variable and may be optimized to a decoded signal curve error being within a predetermined threshold. The decoded signal curve error is caused by using scaled values for the coefficients and difference indicators with the encoded data. The decoded signal curve error in FIG. 4A is the difference between the input data (signal curve) and the decoded data (decoded signal curve). Achieving an error within a predetermined threshold (e.g., up to 1%, or up to 5%) may require a finer scaling of the scaled values of the coefficients and/or the difference indicators. A finer scaling may require a greater number of bits to encode the coefficients and/or the difference indicators.

In at least one embodiment, an inverse transformation function (such as an inverse logarithmic function) may be performed to the representative logarithmic data of the decoded signal curve to generate count data for the different energy windows (inverse transformed decoded signal curve). For example, the number of datapoints in the assigned energy windows 312 are known as per the encoding algorithm. In at least one embodiment, therefore, once the representative logarithmic values, which are mostly faithful to the log transform (EWavg) values, are determined by the inverse logarithmic function, they can be adjusted to the number of datapoints to recreate the Compton windows 312 to arrive at the levels of at least the Potassium, the Uranium, and the Thorium in the downhole environment.

In at least one embodiment, the counts of the windows may be always a superposition of multiple elements. Thus, the approach herein would be considered to be an approximation. While, alternatively, inverse modeling, such as a linear inversion or matrix inversey=A*kuth may be performed, where A includes endmember curves (100%) for the individual elements (such as for K, U, Th elements), the present approach is able to compress data, while also providing a comparable communication of elemental contents or at least one parameter from a downhole environment.

Further, such an approach may also apply to data exhibiting a trend, such as to exponential or other decay or growth, where such data is being transmitted between downhole tools and a surface equipment. In at least one embodiment, the signals may be gamma radiation (GR) signals, optical signals, or other electromagnetic waves or radiation. In at least one embodiment, using GR for the signals, counts or counts per second associated with the GR signals may be recorded for compression and communication herein. In at least one embodiment, the method herein is applicable for communicating any downhole data exhibiting rising and falling trends, including using signals that are acoustical, pressure-base, flow rates-base, or resistivity-based signals. In at least one embodiment, for applications including energy windows (such as described in FIG. 4A), data point numbers may be used, instead. As such, the data points may be on an x-axis and a measure of the signal component that reflect element composition or data trends, such as the pressure, flow-rates, and others, may be on the y-axis, without a need for a log transform.

In a downhole application Gamma spectra are to be detected at different borehole depths, such as in a wireline logging application or a logging while drilling application. The method described in the application may be performed to a plurality of input data (FIG. 4A), such as a plurality of signal curves, corresponding to gamma spectra received at different borehole depths. Input data, as provided in FIG. 4A, may be received at a detector at a plurality of depth values along a borehole. The encoding and transmission of data from a downhole environment to a surface environment may be performed in real time, while drilling a wellbore, for the input data received at the detector at the plurality of depth values, providing a plurality of encoded data.

Each of the plurality of encoded data may relate to a depth value. Decoded data, associated with the transmitted plurality of encoded data, may be used to perform a borehole operation, such as generating a data log (signal curves (gamma spectra) over depth) at the surface environment outside the borehole in real time, while drilling the wellbore, changing an operational parameter (such as a drilling parameter), and adjusting a drilling trajectory in real time.

Figure 4B:
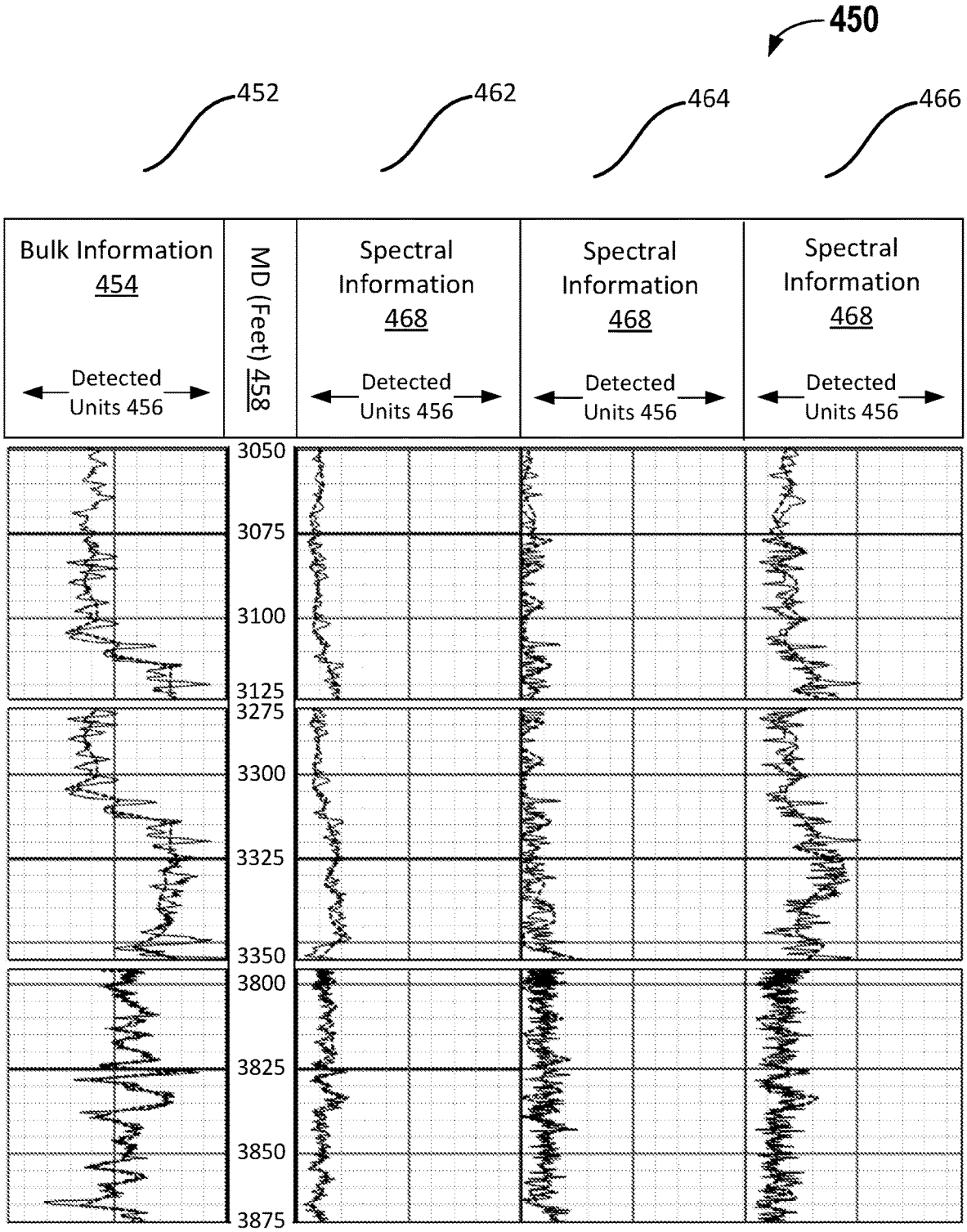
FIG. 4B illustrates a data log that may be displayed in a user interface that is associated with data handling in downhole operations, in at least one embodiment herein.

FIG. 4B illustrates a data log 450 that may be displayed in a user interface that is associated with data handling in downhole operations. The data log 450 illustrates information of occurrence of KUTh elements in the downhole environment over borehole depth (e.g., measured depth (MD) from 3050 feet to 3125 feet in the uppermost depth interval). In the left track 452 of the data log 450, bulk information 454 of occurrence of gamma emitting elements (KUTh) is displayed. The bulk information of occurrence in the left track is provided in API units (American Petroleum Institute), from zero API on the left to 150 API on the right. The bulk information of occurrence relates to the occurrence of gamma emitting elements in the downhole environment (such as KUTh elements) emitting gammas in the detected energy range. The solid line (with jitters) in the left track represents the bulk information of occurrence as measured downhole and stored to the downhole tool memory (also referred to herein as "Spectral GR-Bulk—Memory") that is associated with different depths 458 (feet as units) in the y-axis.

The jitter in the memory data may be related to noise or environmental effects. In addition to the data from memory ("Spectral GR-Bulk—Memory"), data from real time (bulk information of occurrence) may be displayed in the same data log 450. The data from real time is from after encoding the gamma spectrum recorded at a downhole environment at each depth location, which is then provided as encoded data that is transmitted to the surface environment and decoded. This is provided in FIG. 4B, also within the bulk information of occurrence 454, within the same plot of depths 458 but displayed as a broken line without jitters to represent "Spectral-GR-Bulk, Real Time (encoded-decoded)." As can be seen in the left track, there exists a good agreement of the information from the memory and the information decoded at the surface environment that proves the capability of the compression method as described herein.

In at least one embodiment, therefore, the system herein receives first signals at a first borehole depth defining a first signal curve and receives second signals at a second borehole depth defining a second signal curve. In at least one embodiment, the memory data represents data that is downloaded from the downhole tool after the drilling operation was terminated and when the downhole tool is back at the surface environment. As illustrated in FIG. 4B, this memory data can be plotted in the data log 450 for illustrative purposes, such as, to prove the performance of the encoding method. The left track 452 in the data log displays that the encoded data transmitted to the surface environment allows a valid representation of the Spectral GR-Bulk data as recorded in the downhole environment.

In at least one embodiment, three further tracks 462-466 is provided to the right side of the first track 452 and illustrates different spectral components 468 of the Gamma spectra, such as Potassium (K), Uranium (U), and Thorium (Th), in the same y-axis 458 (depth). The x axis 456 represents information of occurrence that is either in percentage or in parts per million (ppm). While the memory data may be recorded downhole and downloaded from downhole tool memory, this is illustrated, side-by-side, with real time data that is decoded at the surface environment from the transmitted encoded data, represented in the broken lines to the memory data represented (with jitters) in the solid line.

To achieve the spectral contributions of Potassium, Uranium, and Thorium, the decoded data (such as the decoded signal curves) may undergo inverse modeling, as described earlier in this description. Based on the spectral GR information the occurrences of Potassium, Uranium, and Thorium in the downhole environment can be determined for different depths along the borehole, allowing identification of specific downhole environment rock formations or allowing to map lithologies, such as identify clay minerals over depth and shown in the data log 450. All the data illustrated in the data log 450 may be corrected for environmental effects on the data (borehole size, mud composition, etc.). The data log 450 displays the bulk information and the spectral information in three different depth intervals, such as between 3050 feet to 3125 feet, 3275 feet to 3350 feet, and 3800 feet to 3875 feet.

Figure 5A:
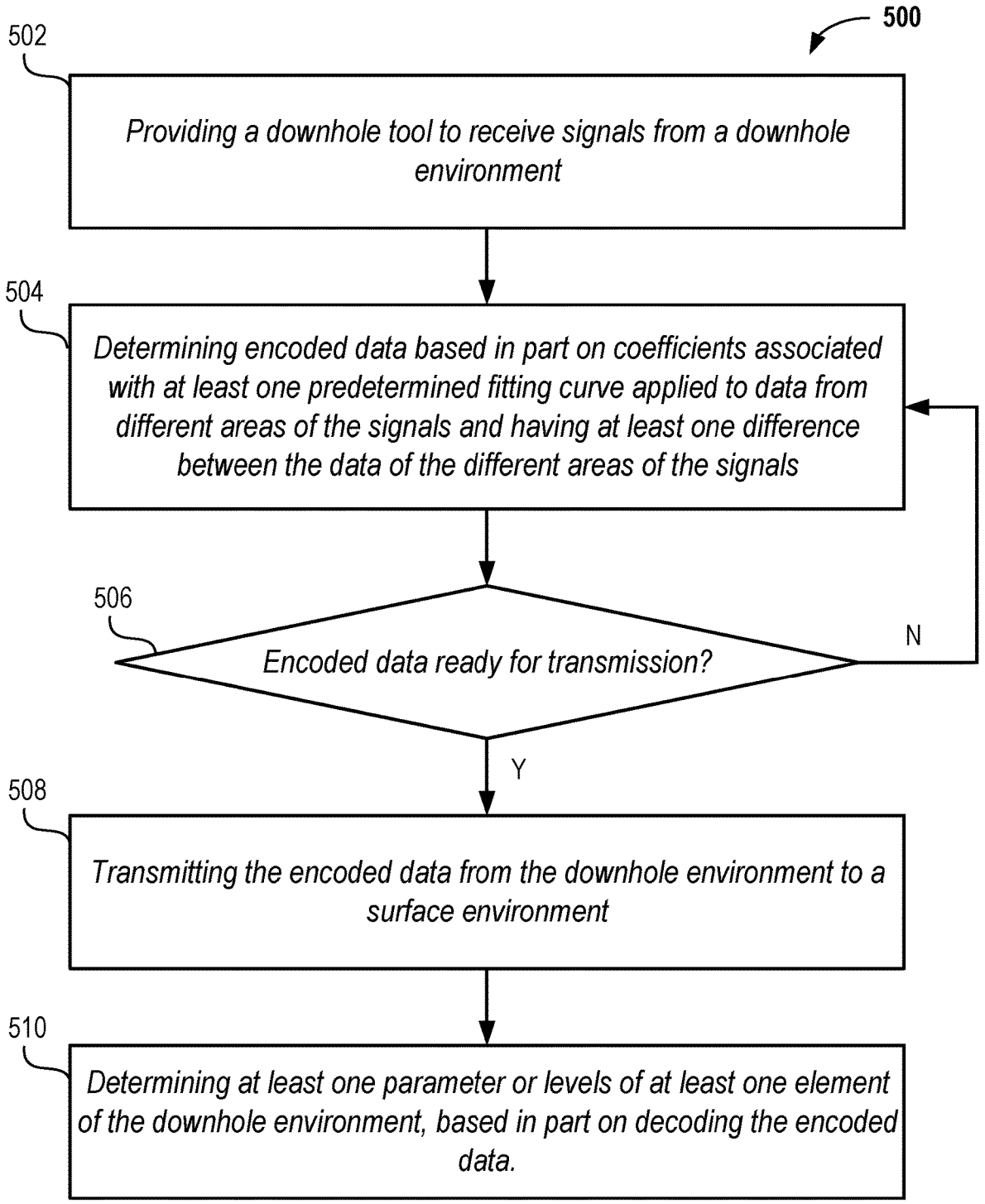
FIG. 5A illustrates a method for data handling in downhole operations, in at least one embodiment.

FIG. 5A illustrates a method 500 for data handling in downhole operations, in at least one embodiment. As discussed in reference to at least FIGS. 3 to 4B, the method 500 includes providing 502 a downhole tool to receive signals from a downhole environment. A further step is performed in the method 500 for determining 504 encoded data for the signals. The encoded data is based at least in part on coefficients associated with at least one predetermined fitting curve applied to data from different areas of the signals. Further, the coefficients include at least one difference between the data of the different areas of the signals and the at least one predetermined fitting curve. For example, the encoded data may be based in part on a slope, an intercept, and at least one error or a log difference that is a log to the base 2 difference between logarithmic data of different energy windows of the signals and at least one predetermined fitting curve.

In at least one embodiment, the method 500 includes determining or verifying 506 that the encoded data is ready for transmitting, such as by checking that a bit register is full. In at least one embodiment, the method 500 includes transmitting 508 the encoded data from the downhole environment to a surface environment. In at least one embodiment, the method 500 includes determining 510 at least one parameter or levels of different elements in the downhole environment, based in part on decoding the encoded data. The at least one parameter in the downhole environment includes an occurrence of at least one radioactive element in the downhole environment. For example, levels of at least Potassium, Uranium, and Thorium in the downhole environment may be determined based in part on decoding the encoded data.

Figure 5B:
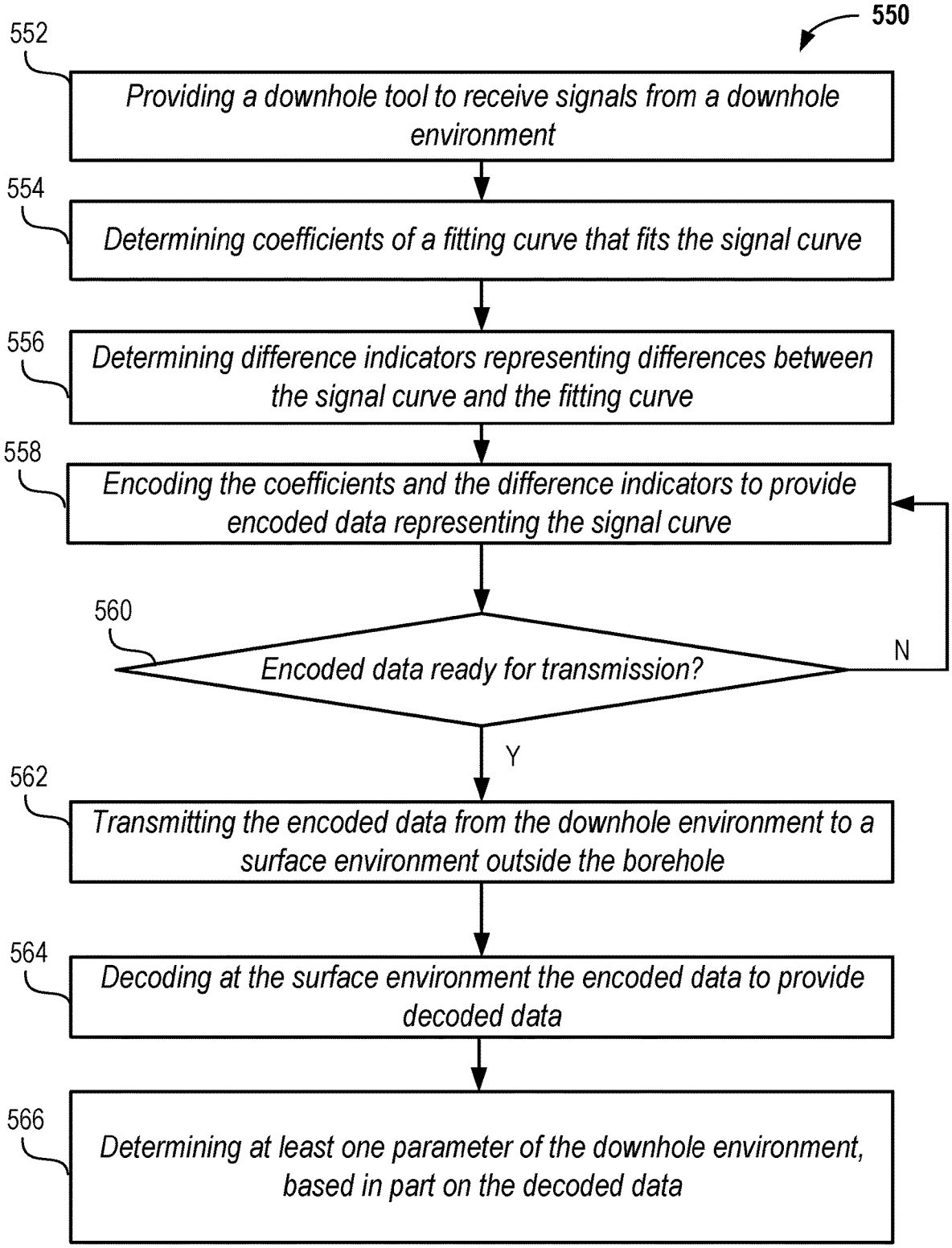
FIG. 5B illustrate another method for data handling in downhole operations, in at least one embodiment.

FIG. 5B illustrate another method 550 for data handling in downhole operations, in at least one embodiment. The method 550 may be performed with the method 500 in FIG. 5A or may be performed distinctly from the method 500 in FIG. 5A. The method 550 in FIG. 5B includes providing 552 a downhole tool to receive signals from a downhole environment within a borehole. The signals define a signal curve. For example, the method 550 includes receiving first signals at a first borehole depth defining a first signal curve and receiving second signals at a second borehole depth defining a second signal curve.

The method 550 includes determining 554 coefficients of a fitting curve that fits the signal curve (where, for example, a first signal curve is detected at the first depth and/or a second signal curve is detected at the second signal curve). The method includes determining 556 difference indicators representing differences between the signal curve and the fitting curve. The method includes encoding 558 the coefficients and the difference indicators to provide encoded data representing the signal curve. A verification 560 may be performed that the encoded data is ready for transmission. For example, the encoded data is filled to a buffer and represents the verification 560 performed. The method 550 includes transmitting 562 the encoded data from the downhole environment to a surface environment outside the borehole. The method 550 includes receiving and decoding 564, at the surface environment, the encoded data to provide decoded data. The method 550 includes determining 566 at least one parameter of the downhole environment, based in part on the decoded data. In one embodiment the verification step 560 may be omitted.

In at least one embodiment, the signal curve has a number of count rates in a number of energy windows. Further, the at least one parameter in the downhole environment, as part of step 566, may include an occurrence of at least one radioactive element in the downhole environment. The method 550 includes a step or sub-step for providing a pulsed neutron source in the downhole tool. The pulsed neutron source is associated with a neutron-induced gamma radiation in the downhole environment. Further, the received the signals from the downhole environment are related to the neutron-induced gamma radiation. The method 550 supports that the at least one radioactive element includes one of Potassium, Uranium, or Thorium, in the downhole environment.

The method 550 includes a step or sub-step for generating, as part of the decoding at the surface environment, a decoded signal curve using the decoded data. A further step or sub-step is for performing an inverse modeling based on the decoded signal curve to determine the occurrence of the at least one radioactive element in the downhole environment. Further, the method 550 includes a step or sub-step for subjecting the signal curve to a transformation function to provide a transformed signal curve. Then, a step may be performed for determining the fitting curve based on the transformed signal curve.

In the method 550, the transformation function is one of a log 2 function, an inverse tangent transformation function, a square root transformation function, or an exponent power transformation function. Further, the coefficients may include a slope and an intercept and the signal curve may include count rates in at least five energy windows. The method 550 is such that the encoded data includes a predetermined number of bits or may include a variable number of bits. The variable number of bits depends on a predetermined error. The predetermined error may be related to a difference between the signal curve and a decoded signal curve generated from the decoded data.

In at least one embodiment, the signals from the downhole environment are from a borehole operation that includes one of a log generation or a change of an operational parameter. Further, the transmitting 562 step for the encoded data includes transmitting less than 10 bits, or less than 5 bits per second to the surface environment. Still further, transmitting 562 of the encoded data may include the use of one of mud pulse telemetry, acoustic telemetry, or electromagnetic telemetry. In at least one embodiment, the method 550 includes the use of the fitting curve that is a predetermined fitting curve and includes where the coefficients are stored in a memory in the downhole tool.

FIG. 6 illustrates a system 600 for data handling in downhole operations, according to at least one embodiment. The system 600 may include computer and network aspects. In at least one embodiment, these computer and network aspects 600 may include a distributed system. In at least one embodiment, a distributed system 600 may include one or more computing devices 612, 614. In at least one embodiment, one or more computing devices 612, 614 may be adapted to execute and function with a client application, such as with browsers or a stand-alone application, and are adapted to execute and function over one or more network(s) 606, which may include downhole inter-tool communications and telemetry to surface (such as using mud pulse telemetry, acoustic telemetry, electromagnetic telemetry), with a receiver (e.g., a pressure transducer or an antenna) on a surface being capable of telemetry acquisition.

In at least one embodiment, a server 604, having components 604A-N may be communicatively coupled with computing devices 612, 614 via network 606 and via a receiver device or detector 608, if provided. In at least one embodiment, components 612, 614 include processors, memory, and random-access memory (RAM). In at least one embodiment, server 604 may be adapted to operate services or applications to manage functions and sessions associated with database access 602 and associated with computing devices 612, 614. In at least one embodiment, a server 604 may be associated with a detector 608 of a downhole tool 620, where such a detector may include a crystal scintillator. In at least one embodiment, a photomultiplier 618 may be associated with the downhole tool 620.

In at least one embodiment, an encoder and transmitter 616 may be associated with the photomultiplier 618. In at least one embodiment, an encoder and transmitter 616 may include a processor and memory having instructions that when executed by the processor can cause the encoder and transmitter 616 to perform encoding functions described throughout herein and at least in reference to FIGS. 3, 4, and 5.

In at least one embodiment, a server 604 may be at a wellsite location, but may also be at a distinct location from a wellsite location to perform decoding functions described throughout herein and at least in reference to FIG. 4A or FIG. 4B. In at least one embodiment, such a server 604 may support a downhole tool 620 for data handling in downhole operations in a downhole environment 622. Such a tool 620 may operate partly downhole and partly at a surface environment. Such a tool 620 may include subsystems to perform functions described throughout herein.

The subsystems may be modules that may be able to test or train a system on a surface level using the predetermined fitting curves as an activation function for instance. The subsystem may be encased in one or more computing devices having at least one processor and memory so that the at least one processor can perform functions based in part on instructions from the memory executing in the at least one processor. In at least one embodiment, even though illustrated together, the system boundary 618 may be part of a detector 608 and an encoder and transmitter 616. In at least one embodiment, the server 604 and computing devices 610-614 may be in different geographic locations, including downhole and surface areas.

A signal detector 608 of a downhole tool 620 is provided to test downhole elemental compositions in a downhole environment 622. In at least one embodiment, signals may be natural GR signals or return signals associated with neutron-induced gamma spectroscopy. Therefore, the downhole tool 620 can emit moderate-energy neutrons into the downhole environment 622. In at least one embodiment, a system for analysis of elements of a downhole environment includes a LWD system for the analysis, where such a system may be adapted to transmit, either through wires or wireless, information received therein, from a downhole environment to a surface environment. In at least one embodiment, modeling in an encoder and transmitter 616 can be performed using different predetermined fitting curves may allow further variations to the predetermined fitting curves than just slope and intercept variations.

The encoder and transmitter 616 can communicate with a photomultiplier 618 which communicates with a crystal scintillator 608. In at least one embodiment, each predetermined fitting curve may require specific input from a server 604 to be used to fit input received from gamma-ray signals. In at least one embodiment, trained ML/AI algorithms (machine learning (ML), or artificial intelligence (AI)) may be used with each predetermined fitting curve forming an activation function to classify logarithmic data of different energy windows of the signals. In at least one embodiment, a least error may reinforce the use of the same predetermined fitting curve for future data of different energy windows of the signals.

In at least one embodiment, one or more component 604A-N may be adapted to function as a signal provisioning or detector device within a server 604. In at least one embodiment, one or more components 604A-N may include one or more processors and one or more memory devices adapted to function as a detector or receiver device, while other processors and memory devices in server 604 may perform other functions.

In at least one embodiment, a server 604 may also provide services or applications that are software-based in a virtual or a physical environment (such as to support the simulations referenced herein). In at least one embodiment, when server 604 is a virtual environment, then components 604A-N are software components that may be implemented on a cloud. In at least one embodiment, this feature allows remote operation of a system for analysis of a KUTh elemental composition using an LWD system in real time that relies on a downhole tool, as discussed at least in reference to FIGS. 1-5. In at least one embodiment, this feature also allows for remote access to information received and communicated between any of aforementioned devices. In at least one embodiment, one or more components 604A-N of a server 604 may be implemented in hardware or firmware, other than a software implementation described throughout herein. In at least one embodiment, combinations thereof may also be used.

In at least one embodiment, one computing device 610-614 may be a smart monitor or a display having at least a microcontroller and memory having instructions to enable display of information monitored by a detector. In at least one embodiment, one computing device 610 may be a transmitter device to transmit directly to a receiver device or to transmit via a network 606 to a receiver device that may be part of an encoder and transmitter 616 and to transmit to a server 604, as well as to other computing devices 612, 614. In at least one embodiment, the encoder and transmitter 616, even if illustrated together, are separate components that may be a separate encoder and a separate transmitter. The encoder may include a processor that performs the selection of the fitting curve from the predetermined fitting curves and the difference calculation (errors). The transmitter may control the transmission of the encoded data to the surface location by using one of the mentioned telemetry methods (e.g., mud pulse telemetry).

In at least one embodiment, other computing devices 612, 614 may include portable handheld devices that are not limited to smartphones, cellular telephones, tablet computers, personal digital assistants (PDAs), and wearable devices (head mounted displays, watches, etc.). In at least one embodiment, other computing devices 612, 614 may operate one or more operating systems including Microsoft Windows Mobile®, Windows® (of any generation), and/or a variety of mobile operating systems such as iOS®, Windows Phone®, Android®, BlackBerry®, Palm OS®, and/or variations thereof.

In at least one embodiment, other computing devices 612, 614 may support applications designed as internet-related applications, electronic mail (email), short or multimedia message service (SMS or MMS) applications and may use other communication protocols. In at least one embodiment, other computing devices 612, 614 may also include general purpose personal computers and/or laptop computers running such operating systems as Microsoft Windows®, Apple Macintosh®, and/or Linux®. In at least one embodiment, other computing devices 612, 614 may be workstations running UNIX® or UNIX-like operating systems or other GNU/Linux operating systems, such as Google Chrome OS®. In at least one embodiment, thin-client devices, including gaming systems (Microsoft Xbox®) may be used as other computing device 612, 614.

In at least one embodiment, network(s) 606 may be any type of network that can support data communications using various protocols, including TCP/IP (transmission control protocol/Internet protocol), SNA (systems network architecture), IPX (Internet packet exchange), AppleTalk®, and/or variations thereof. In at least one embodiment, network(s) 606 may be a networks that is based on Ethernet, Token-Ring, a wide-area network, Internet, a virtual network, a virtual private network (VPN), a local area network (LAN), an intranet, an extranet, a public switched telephone network (PSTN), an infra-red network, a wireless network (such as that operating with guidelines from an institution like the Institute of Electrical and Electronics (IEEE) 802.11 suite of protocols, Bluetooth®, and/or any other wireless protocol), and/or any combination of these and/or other networks.

In at least one embodiment, a server 604 runs a suitable operating system, including any of operating systems described throughout herein. In at least one embodiment, server 604 may also run some server applications, including HTTP (hypertext transport protocol) servers, FTP (file transfer protocol) servers, CGI (common gateway interface) servers, JAVA® servers, database servers, and/or variations thereof. In at least one embodiment, a database 602 is supported by database server feature of a server 604 provided with front-end capabilities. In at least one embodiment, such database server features include those available from Oracle®, Microsoft®, Sybase®, IBM® (International Business Machines), and/or variations thereof.

In at least one embodiment, a server 604 is able to provide feeds and/or real-time updates for media feeds. In at least one embodiment, a server 604 is part of multiple server boxes spread over an area but functioning for a presently described process for analysis of a porous formation. In at least one embodiment, server 604 includes applications to measure network performance by network monitoring and traffic management. In at least one embodiment, a provided database 602 enables information storage from a wellsite, including user interactions, usage patterns information, adaptation rules information, and other information.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two but can be more when so indicated either explicitly or by context. Further, unless stated otherwise or otherwise clear from context, phrases such as based on means based at least in part on and not based solely on.

Operations of methods in FIG. 5, and the sub-steps described herein can be performed in any suitable order unless otherwise indicated herein or otherwise clearly contradicted by context. In at least one embodiment, a method includes processes such as those processes described herein (or variations and/or combinations thereof) that may be performed under control of one or more computer systems configured with executable instructions and that may be implemented as code (e.g., executable instructions, one or more computer programs or one or more applications) executing collectively or exclusively on one or more processors, by hardware or combinations thereof.

In at least one embodiment, such code may be stored on a computer-readable storage medium. In at least one embodiment, such code may be a computer program having instructions executable by one or more processors. In at least one embodiment, a computer-readable storage medium is a non-transitory computer-readable storage medium that excludes transitory signals (such as a propagating transient electric or electromagnetic transmission) but includes non-transitory data storage circuitry (such as buffers, cache, and queues) within transceivers of transitory signals. In at least one embodiment, code (such as executable code or source code) is stored on a set of one or more non-transitory computer-readable storage media having stored thereon executable instructions (or other memory to store executable instructions) that, when executed (such as a result of being executed) by one or more processors of a computer system, cause computer system to perform operations described herein.

In at least one embodiment, a set of non-transitory computer-readable storage media includes multiple non-transitory computer-readable storage media and one or more of individual non-transitory storage media of multiple non-transitory computer-readable storage media lack all of code while multiple non-transitory computer-readable storage media collectively store all of code. In at least one embodiment, executable instructions are executed such that different instructions are executed by different processors—in at least one embodiment, a non-transitory computer-readable storage medium store instructions and a main central processing unit (CPU) executes some of instructions while other processing units execute other instructions. In at least one embodiment, different components of a computer system have separate processors and different processors execute different subsets of instructions.

In at least one embodiment, computer systems are configured to implement one or more services that singly or collectively perform operations of processes described herein and such computer systems are configured with applicable hardware and/or software that enable performance of operations. In at least one embodiment, a computer system that implements at least one embodiment of present disclosure is a single device or is a distributed computer system having multiple devices that operate differently such that distributed computer system performs operations described herein and such that a single device does not perform all operations.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages and can be used in a variety of applications. Various embodiments may be combined or modified based in part on the present disclosure, which is readily understood to support such combination and modifications to achieve the benefits described above.

As such, a method for data handling in downhole operations can include providing a downhole tool to receive signals from a downhole environment and determining encoded data for the signals. The encoded data may be based in part on coefficients associated with a transformation function applied to data of different energy windows of the signals. For example, the encoded data is from encoding coefficients and difference indicators to provide encoded data representing a signal curve. The coefficients and difference indicators can include at least one error between data of different energy windows of the signals and at least one predetermined fitting curve. The method includes transmitting the encoded data from the downhole environment to a surface environment and determining at least one parameter or levels of one or more elements in the downhole environment based in part on decoding the encoded data.

Such a method can also include determining levels of at least Potassium, Uranium, and Thorium, which may be the one or more elements or associated with at least one parameter in the downhole environment. Further, such a method makes use of logarithmic data of the different energy windows, where the transformation function is a logarithmic transformation function. The method can further include performing curve fitting between the data of the different energy windows of the signals and a plurality of different predetermined fitting curves. Such predetermined fitting curves may be logarithmic regression curves having different slopes and different intercepts and can fit the input curve for the different energy windows. The method can include selecting the at least one predetermined fitting curve from the predetermined fitting curves based at least in part on a statistical significance for the at least one error being within a predetermined threshold.

The method can include generating, as part of the decoding at the surface environment, representative data (such as logarithmic data) using the coefficients from the encoded data. Then an inverse function, such as an inverse logarithmic function can be performed, to the representative data to generate count data for the different energy windows. The method includes analyzing the count data to arrive at the levels (occurrences) of at least one element, such as Potassium, Uranium, or Thorium, in the downhole environment.

In at least one embodiment, the method includes using, as the coefficients, a slope that contributes a 3-bits value to the encoded data, the intercept contributes a 3-bits value to the encoded data, and the at least one error contributes a 4-bits value to the encoded data. Further, the 3-bits value may be one example; and the transformation function coefficients may include a third-order polynomial with 4 coefficients and sufficient bits are provided to support this, but such total bits remain compressed relative to other approaches.

In at least one embodiment, the 4-bits value includes an n-bit (+1), representing a sign of the at least one error. The method herein includes using assigned numbers of the different energy windows of the signals form part of the encoded data and performing the transmitting of the encoded data at a predetermined communication speed. In at least one embodiment, the method herein includes providing the encoded data in a total of 42 bits for individual depth locations of the downhole tool. For example, in a case of 9 windows with 4 bits per value in addition to 2×3 intercept and slope, there could be many other sizes that still represent compressed data relative to taking all the provided bits for communication.

In at least one embodiment, a method for data handling in downhole operations is disclosed. In at least one embodiment, such a method includes providing a downhole tool to receive signals from a downhole environment. A further step in such a method includes determining encoded data for the signals. The encoded data may be based in part on coefficients associated with a transformation function applied to data from different areas of the signals. In at least one embodiment, the coefficients include at least one error between the data of the different areas of the signals and at least one predetermined fitting curve. In at least one embodiment, the method includes transmitting the encoded data from the downhole environment to a surface environment. Furthermore, the method includes determining at least one parameter or levels of different elements in the downhole environment, based in part on decoding the encoded data.

In at least one embodiment, a system for data handling in a downhole operation includes a downhole tool to receive signals from a downhole environment and at least one processor and memory comprising instructions that when executed by the at least one processor cause the system to perform functions. A function includes determining encoded data for the signals. The encoded data is based in part on coefficients associated with a transformational function. The coefficients may include a slope, an intercept, and at least one error. The at least one error may be between data of different energy windows of the signals and at least one predetermined fitting curve. A function includes transmitting the encoded data from the downhole environment to a surface environment. A further function includes determining at least one parameter or levels of at least element in the downhole environment, based in part on decoding the encoded data.

What is claimed is:

1. A method comprising:

providing a downhole tool to receive signals from a downhole environment within a borehole, the signals defining a signal curve;

determining coefficients of a fitting curve that fits the signal curve;

determining difference indicators representing differences between the signal curve and the fitting curve;

encoding the coefficients and the difference indicators to provide encoded data representing the signal curve;

transmitting the encoded data from the downhole environment to a surface environment outside the borehole;

decoding, at the surface environment, the encoded data to provide decoded data; and determining at least one parameter of the downhole environment, based in part on the decoded data.

2. The method of claim 1, wherein the signal curve includes a plurality of count rates in a plurality of energy windows and the at least one parameter of the downhole environment includes an occurrence of at least one radioactive element in the downhole environment.

3. The method of claim 1, further comprising:

providing a pulsed neutron source in the downhole tool, the pulsed neutron source associated with a neutron-induced gamma radiation in the downhole environment, wherein the received signals from the downhole environment are related to the neutron-induced gamma radiation.

4. The method of claim 2, wherein the at least one radioactive element comprising one of Potassium, Uranium, or Thorium, in the downhole environment.

5. The method of claim 2, further comprising:

generating, as part of the decoding at the surface environment, a decoded signal curve using the decoded data; and performing an inverse modeling based on the decoded signal curve to determine the occurrence of the at least one radioactive element in the downhole environment.

6. The method of claim 1, further comprising:

subjecting the signal curve to a transformation function to provide a transformed signal curve; and determining the fitting curve based on the transformed signal curve.

7. The method of claim 6, wherein the transformation function is one of a log 2 function, an inverse tangent transformation function, a square root transformation function, or an exponent power transformation function.

8. The method of claim 1, wherein the coefficients include a slope and an intercept.

9. The method of claim 1, wherein the signal curve includes count rates in at least five energy windows.

10. The method of claim 1, wherein the encoded data includes a predetermined number of bits.

11. The method of claim 1, wherein the encoded data includes a variable number of bits, wherein the variable number of bits depends on a predetermined error, and wherein the predetermined error is related to a difference between the signal curve and a decoded signal curve generated from the decoded data.

12. The method of claim 1, further including performing a borehole operation based on the determined at least one parameter of the downhole environment, wherein the borehole operation comprises one of a log generation or a change of an operational parameter.

13. The method of claim 1, wherein transmitting the encoded data includes transmitting less than 10 bits per second from the downhole environment to the surface environment.

14. The method of claim 1, wherein transmitting the encoded data includes one of mud pulse telemetry, acoustic telemetry, or electromagnetic telemetry.

15. The method of claim 1, wherein the fitting curve is a predetermined fitting curve and wherein the coefficients are stored in a memory in the downhole tool.

16. The method of claim 1, wherein receiving the signals from the downhole environment further comprises:

receiving first signals at a first borehole depth defining a first signal curve and receiving second signals at a second borehole depth defining a second signal curve, determining first coefficient of the fitting curve that fits the first signal curve and determining second coefficients of the fitting curve that fits the second signal curve.

17. A system for data handling in downhole operations, the system comprising:

a downhole tool to receive signals from a downhole environment within a borehole, the signals defining a signal curve;

memory storing instructions; and a processor to execute the instructions from the memory to cause the system to:

determine coefficients of a fitting curve that fits the signal curve;

determine difference indicators representing differences between the signal curve and the fitting curve;

encode the coefficients and the difference indicators to provide encoded data representing the signal curve;

transmit the encoded data from the downhole environment to a surface environment outside the borehole;

decode at the surface environment the encoded data to provide decoded data; and determine at least one parameter of the downhole environment, based in part on the decoded data.

18. The system of claim 17, wherein the instructions, when executed by the processor, further cause the system to:

subject the signal curve to a transformation function to provide a transformed signal curve; and determine the fitting curve based on the transformed signal curve.

19. The system of claim 17, wherein the instructions, when executed by the processor, further cause the system to:

generate, as part of the decoding at the surface environment, a decoded signal curve using the decoded data; and performing an inverse modeling based on the decoded signal curve to determine the occurrence of at least one radioactive element in the downhole environment.

20. The system of claim 17, wherein the signal curve includes a plurality of count rates in a plurality of energy windows and the at least one parameter in the downhole environment includes an occurrence of at least one radioactive element in the downhole environment.

* * * * *